US008164535B2

(12) United States Patent
Lin

(10) Patent No.: US 8,164,535 B2
(45) Date of Patent: Apr. 24, 2012

(54) COPLANAR WAVEGUIDE FED PLANAR LOG-PERIODIC ANTENNA

(75) Inventor: Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 622 days.

(21) Appl. No.: 12/408,071

(22) Filed: Mar. 20, 2009

(65) Prior Publication Data

US 2010/0182212 A1 Jul. 22, 2010

(30) Foreign Application Priority Data

Jan. 17, 2009 (TW) ..... 98101765 A

(51) Int. Cl.
*H01Q 11/10* (2006.01)

(52) U.S. Cl. ..... 343/792.5; 343/700 MS; 343/770; 343/793; 343/795; 343/821

(58) Field of Classification Search ..... 343/700 MS, 343/770, 792.5, 793, 795, 821
See application file for complete search history.

(56) References Cited

U.S. PATENT DOCUMENTS

| | | | | | |
|---|---|---|---|---|---|
| 3,550,143 | A * | 12/1970 | Grant | ..... | 343/792.5 |
| 4,763,131 | A * | 8/1988 | Rosser et al. | ..... | 343/792.5 |
| 4,907,011 | A * | 3/1990 | Kuo | ..... | 343/792.5 |
| 6,094,176 | A * | 7/2000 | Van Hoozen et al. | ..... | 343/792.5 |
| 6,362,796 | B1 * | 3/2002 | Bohlman | ..... | 343/895 |
| 6,731,248 | B2 * | 5/2004 | Killen et al. | ..... | 343/792.5 |
| 6,734,827 | B2 * | 5/2004 | Killen et al. | ..... | 343/792.5 |
| 7,259,725 | B2 * | 8/2007 | Wang et al. | ..... | 343/792.5 |
| 7,292,197 | B2 * | 11/2007 | Goldberg et al. | ..... | 343/792.5 |
| 7,545,338 | B2 * | 6/2009 | McLean | ..... | 343/792.5 |
| 7,583,233 | B2 * | 9/2009 | Goldberg et al. | ..... | 343/792.5 |
| 2007/0182655 | A1 * | 8/2007 | Lee et al. | ..... | 343/792.5 |

* cited by examiner

*Primary Examiner* — Douglas W Owens
*Assistant Examiner* — Chuc Tran
(74) *Attorney, Agent, or Firm* — Peter F. Corless; Steven M. Jensen; Edwards Wildman Palmer LLP

(57) ABSTRACT

A CPW fed planar log-periodic antenna is provided. The antenna includes: an upper substrate; a planar log-periodic antenna structure formed beneath the upper substrate; a CPW-fed structure formed on the upper substrate for feeding energy into the planar log-periodic antenna structure; a lower substrate disposed beneath the upper substrate; and a wire structure formed beneath the lower substrate. The antenna of the present invention features efficient reduction of cross polarized radiation and thereby enhancing the performance.

26 Claims, 7 Drawing Sheets

COPLANAR WAVEGUIDE FED PLANAR LOG-PERIODIC ANTENNA

BACKGROUND OF THE INVENTION

1. Field of the Invention

The present invention relates generally to an antenna structure, and more particularly to a planar log-periodic antenna using a coplanar waveguide (CPW)-fed technique.

2. Description of Related Art

As communication technology progresses and develops, communication products have become the most economical messaging devices that offer the most extensive range. While the communication products are getting increasingly relied on, more attention will be paid to its mobility and convenience. To overcome the drawbacks in wire communication networks such as inconvenient hardware architecture layout and limited application, wireless communication techniques have been accordingly born.

Wireless communication products have been widely used in modern life as public communication devices or private portable devices. Therein, antennas play an important role in transmitting and receiving radio waves. An antenna is a coupling component or a conductive system through which conversion between an electrical signal in circuit and electromagnetic energy in space can be achieved. When transmitting a signal, the antenna converts radio frequency electrical energy into electromagnetic energy that is further radiated to the surrounding environment. After receiving a signal, the antenna converts electromagnetic radiation into radio frequency electrical energy to be processed by a receiver. When the frequency of a radio signal fed into a transmission line varies, the impedance of the antenna will vary accordingly. As a result, all incident energy can be radiated out from the antenna at a resonant frequency if an appropriate signal feed method and impedance matching are considered. Besides, antenna design will be different according to the type of communication specifications and techniques.

A log-periodic antenna is a frequency-independent antenna with stable energy gain, which can efficiently receive and transmit broadband energy but provides less gain compared with narrow band antennas. The log-periodic antenna, suitable for medium and short wave communication, is able to be applied to various frequencies and elevation angles as well as exhibit directivity. Since the log-periodic antenna has stable input impedance and radiation pattern in the operating frequency band, the log-periodic antenna is often used in electromagnetic compatibility testing.

Among various types of antennas, a planar antenna is the most commonly used one. Due to the characteristics of their small volume, light weight, low cost, high reliability, and easiness to fabricate and attach to any object, planar antennas such as microstrip antennas and printed slot antennas have been significantly applied to wireless communication systems.

A planar log-periodic antenna is a new type of the log-periodic antenna manufactured through etching the surface metal of a substrate. The antenna has a planar structure that is directly formed on a printed circuit board and thus offers advantages of the general planar antennas. However, resonant current of such a structure generates energy in two orthogonal directions, i.e., cross-polarized radiation produced on an X-axis and a Y-axis, thereby resulting in energy loss inside the antenna and leading to low radiation gain on a Z-axis.

Therefore, there is a need to provide a planar log-periodic antenna that provides small volume, low cost, easiness to fabricate and ability to suppress undesired cross-polarized radiation during energy transmission.

SUMMARY OF THE INVENTION

According to the above drawbacks, the present invention provides a CPW fed planar log-periodic antenna, which comprises: an upper substrate; a planar log-periodic antenna structure formed beneath the upper substrate; a CPW-fed structure formed on the upper substrate for feeding energy into the planar log-periodic antenna structure; a lower substrate disposed beneath the upper substrate; and a wire structure formed beneath the lower substrate.

The CPW-fed structure further comprises: a microstrip formed on the upper substrate and having a width increasing towards two edges of the upper substrate; and a through hole vertically formed in the upper substrate and connected to the microstrip and the planar log-periodic antenna structure.

Therein, the microstrip comprises: a signal transmission region with its width increasing towards two edges of the upper substrate, wherein, a first dielectric region, a second dielectric region and a third dielectric region are formed around the signal transmission region, the first dielectric region and the second dielectric region extend towards two edges of the upper substrate and form an angle with the third dielectric region, further, with a fourth dielectric region and a fifth dielectric region formed at locations spaced out a specific distance apart from the first dielectric region and the second dielectric region respectively, with the fourth and fifth dielectric regions extending towards two edges of the upper substrate; and a signal ground region formed outside the signal transmission region and the first to fifth dielectric regions.

The through hole further comprises: a first feed through hole vertically formed in the upper substrate and connected to the signal transmission region and the planar log-periodic antenna structure; and a second feed through hole vertically formed in the upper substrate and connected to the signal ground region and the planar log-periodic antenna structure.

In a preferred embodiment, the planar log-periodic antenna structure further comprises: a first segment formed at one side of the planar log-periodic antenna structure and having a plurality of first subsegments arranged along the first segment and perpendicular to the first segment, wherein the first subsegments are connected to the first segment, and any one of the first subsegments has an extending direction opposite to its two adjacent first subsegments, and a width of the first subsegment is smaller than a distance between the first subsegment and its adjacent first subsegments; and a second segment formed at the other side of the planar log-periodic antenna structure and comprising a plurality of second subsegments, wherein each of the second subsegments is symmetrical to each of the first subsegments with respect to the center of the planar log-periodic antenna structure.

In another preferred embodiment, the planar log-periodic antenna structure further comprises: a third segment formed at one side of the planar log-periodic antenna structure and having a plurality of third subsegments arranged along the third segment and perpendicular to the third segment, wherein the third subsegments are connected to the third segment, and any one of the third subsegment has an extending direction opposite to its adjacent third subsegments, and a width of the third subsegment is smaller than a distance between the third subsegment and its adjacent third subsegments; and a fourth segment formed at the other side of the planar log-periodic antenna structure opposite to the third segment and having a plurality of fourth subsegments arranged along the fourth segment and perpendicular to the fourth segment, wherein the number of the fourth subsegments is same as the number of the third subsegments, the fourth subsegments are connected to the fourth segment, and one of the fourth subsegment has an extending direction opposite to its adjacent fourth subsegments, and a width of each fourth subsegment is smaller than the distance between said fourth subsegment and adjacent fourth subsegments.

Compared with the prior art, the CPW fed planar log-periodic antenna of the present invention not only has advantages of small volume, low cost, easy fabrication, but also encapsulates the planar log-periodic antenna through the wire structure and CPW-fed structure such that energy can only be transmitted in the encapsulated region without radiation, thereby decreasing cross polarized radiation of the antenna and enhancing the operating efficiency of the antenna.

DETAILED DESCRIPTION OF PREFERRED EMBODIMENTS

The following illustrative embodiments are provided to illustrate the disclosure of the present invention, these and other advantages and effects can be apparent to those skilled in the art after reading the disclosure of this specification.

Figure 1:
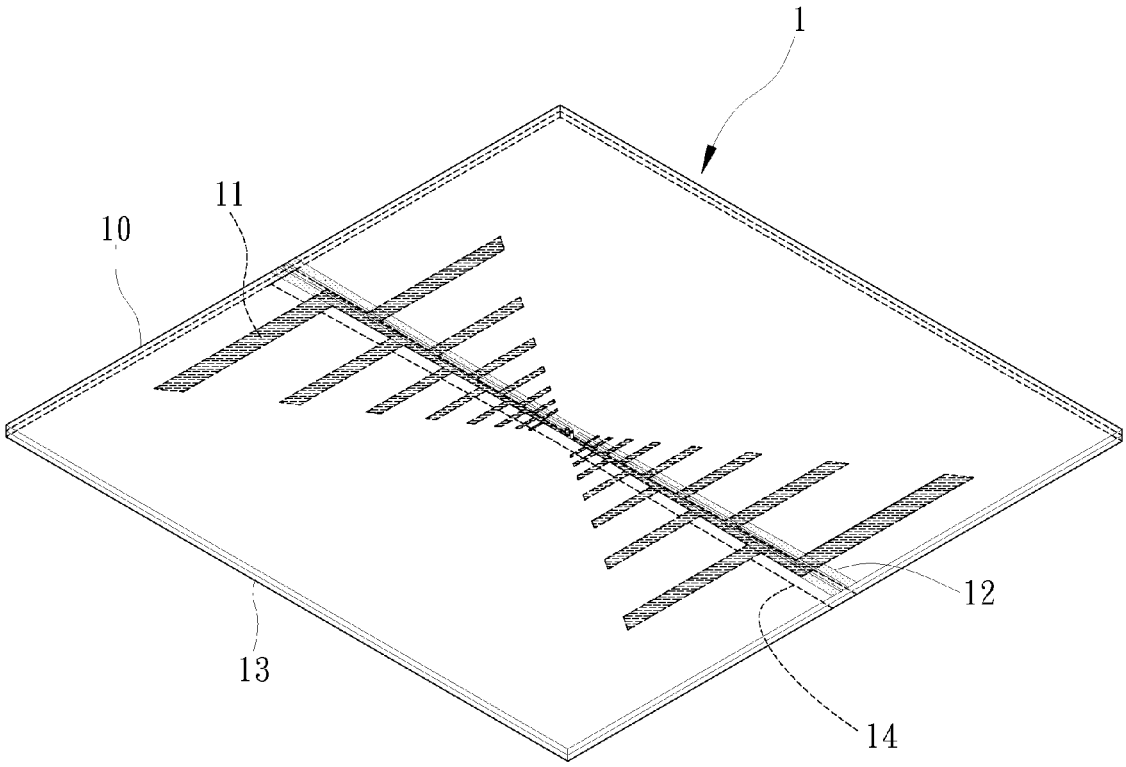
FIG. 1 is a perspective view of a CPW fed planar log-periodic antenna according to the present invention.

FIG. 1 is a perspective view of a CPW fed planar log-periodic antenna 1 according to the present invention. As shown in the drawing, the antenna comprises an upper substrate 10, a planar log-periodic antenna structure 11, a CPW-fed structure 12, a lower substrate 13 and a wire structure 14.

The upper substrate 10 and the lower substrate 13 can be a core substrate of a printed circuit board. The core substrate is generally composed of resin, reinforcement material and/or metal foil. The most common core substrate is a CCL (Copper Clad Laminate) substrate, which is formed by disposing a substrate under high temperature and high pressure and attaching a copper foil to a single surface or double surfaces of the substrate. A polymer resin is used as an adhesive, such as an epoxy resin, a phenolic resin, polyamine formaldehyde, silicone, Teflon and so on. The copper foil is formed by electroplating copper on a roller immersed in a sulfuric acid electrolyte. In the electroplating process, the surface of the copper film becomes rougher and accordingly is easy to be attached to the substrate. The copper foil functions as circuit of electronic components for connecting conductors. But it should be noted that the present invention is not limited to the above-described materials. Other appropriate materials can be used to fabricate the substrate.

The planar log-periodic antenna structure 11 is a specific type of log-periodic antenna. The log-periodic antenna is a frequency-independent antenna with a stable energy gain and can efficiently receive and transmit broadband energy. The log-periodic antenna can be applied to various frequencies and elevation angles and is suitable for medium and short wave communication and exhibits directivity.

Both the CPW-fed structure 12 and wire structure 14 are a kind of planar transmission line, composed of a microstrip structure. The microstrip structure comprises metal segments formed on a substrate, and the metal segments have specific length and width corresponding to desired frequency and impedance characteristics. In the present invention, by disposing the two microstrip structures on and beneath the substrate, radiation in an orthogonal direction is decreased when energy is transmitted in the antenna.

In practice, the planar log-periodic antenna structure 11 and the CPW-fed structure 12 are first formed beneath and on the upper substrate 10, respectively. Then, the wire structure 14 is formed beneath the lower substrate 13. Finally, the upper substrate and the lower substrate are stacked together so as to form the CPW fed planar log-periodic antenna 1.

Figure 2:
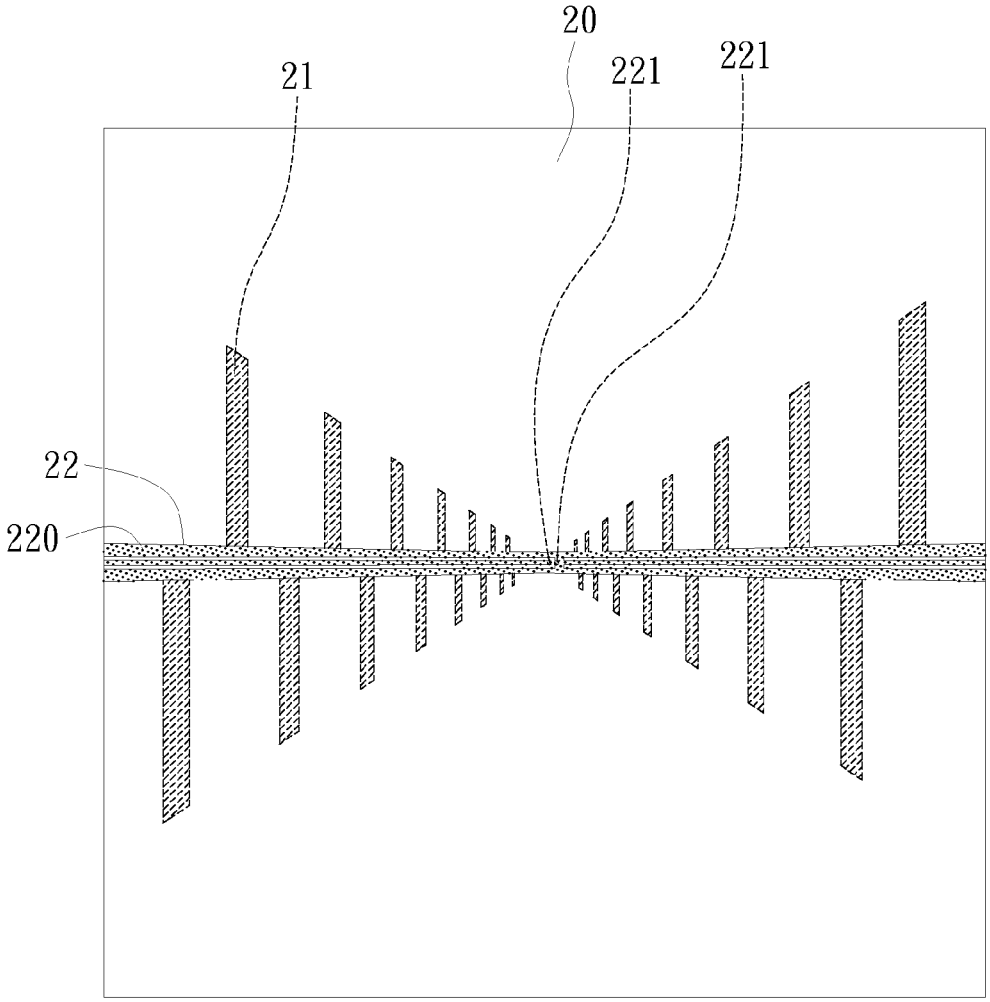
FIG. 2 is a top view of the CPW fed planar log-periodic antenna according to the present invention.

FIG. 2 is a top view of the CPW fed planar log-periodic antenna. As shown in FIG. 2, a CPW-fed structure 22 and a planar log-periodic antenna structure 21 are formed on and beneath an upper substrate 20, respectively. The CPW-fed structure 22 further comprises a microstrip 220 and a through hole 221. The microstrip 220 is a conductive line having specific length and width corresponding to desired frequency and impedance characteristics for energy transmission. The through hole 221 penetrates through the upper substrate 20 for transmitting energy from the microstrip 220 to the antenna beneath the upper substrate 20.

Figure 3A:
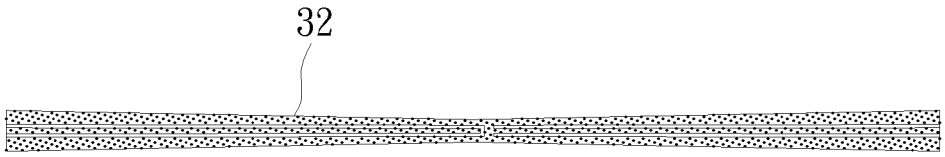
FIG. 3*a* is a top view of the microstrip of the CPW fed planar log-periodic antenna according to the present invention.
Figure 3B:
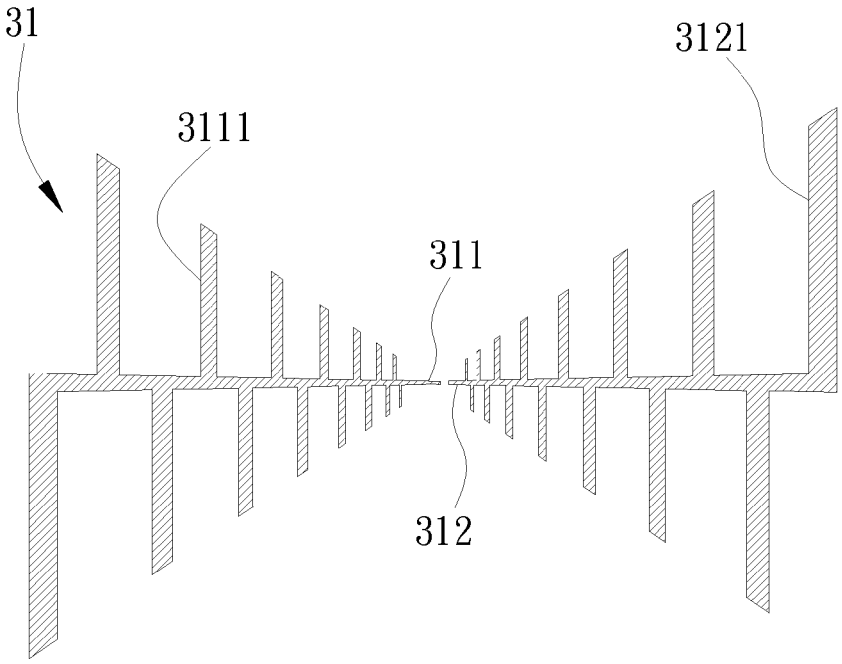
FIG. 3*b* is a top view of the planar log-periodic antenna structure of the CPW fed planar log-periodic antenna according to the present invention.
Figure 3C:
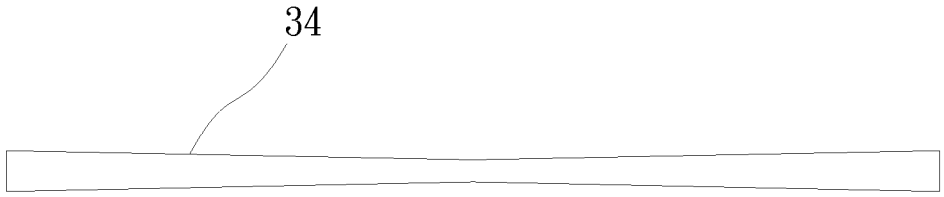
FIG. 3*c* is a top view of the wire structure of the CPW fed planar log-periodic antenna according to the present invention.

FIG. 3*a* is a top view of a microstrip 32 on the upper substrate 10. FIG. 3*b* shows a planar log-periodic antenna structure 31 beneath the upper substrate 10. FIG. 3*c* shows a wire structure 34 beneath the lower substrate 13. As shown in FIG. 3*b*, the planar log-periodic antenna structure 31 comprises a first segment 311 and a second segment 312, wherein the first segment 311 further comprises a plurality of first subsegments 3111 perpendicular to the first segment 311, and the second segment 312 further comprises a plurality of second subsegments 3121 perpendicular to the second segment 312. Those skilled in the art can easily understand the CPW fed planar log-periodic antenna structure of the present invention through FIGS. 3*a* to 3*c*.

Figure 4A:
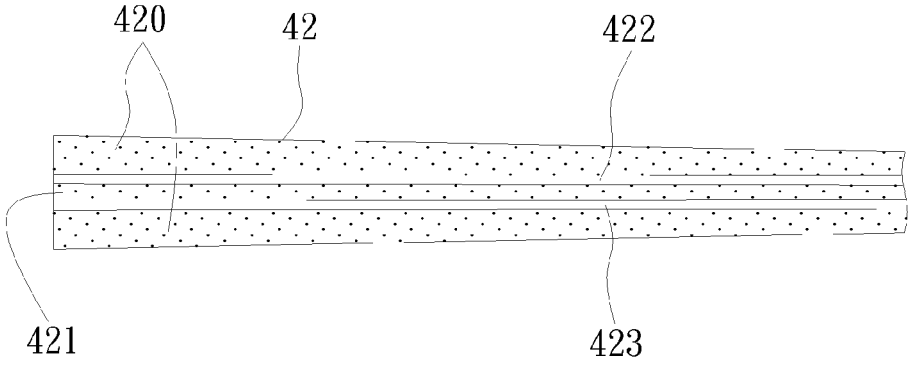
FIGS. 4*a* to 4*c* are top views partially showing the microstrip of the CPW fed planar log-periodic antenna according to the present invention.
Figure 4B:
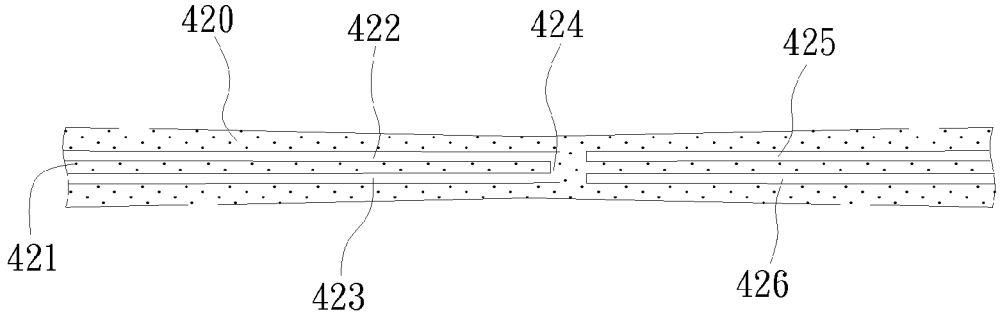
Figure 4C:
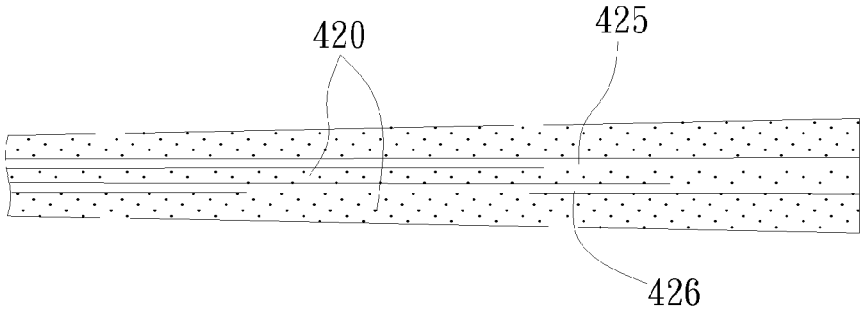

FIGS. 4*a* to 4*c* are top views partially showing a microstrip 42 of the CPW fed planar log-periodic antenna according to the present invention, wherein FIG. 4*a* shows the left part of the microstrip 42, FIG. 4*b* shows the middle part of the microstrip 42, and FIG. 4*c* shows the right part of the microstrip 42. As shown in the drawings, the microstrip 42 comprises a signal ground region 420 and a signal transmission region 421, wherein the width of the signal transmission region 421 increases towards two edges of the upper substrate. A first dielectric region 422, a second dielectric region 423 and a third dielectric region 424 are formed around the signal transmission region 421. The first dielectric region 422 and the second dielectric region 423 extend towards two edges of the upper substrate and form an angle with the third dielectric region 424. A fourth dielectric region 425 and a fifth dielectric region 426 are formed at a location spaced a specific distance away from the first dielectric region 422 and the second dielectric region 423. The fourth dielectric region 425 and the fifth dielectric region 426 extend toward two edges of the upper substrate. The signal ground region 420 is formed outside the signal transmission region 421 and the first to fifth dielectric regions for grounding signals.

In a preferred embodiment, the first and second dielectric regions 422, 423 extend to two edges of the upper substrate. The first and second dielectric regions 422, 423 may have stripped shapes and equal widths.

In another embodiment, the third dielectric region 424 has an stripped shape and specific width.

In another preferred embodiment, the fourth dielectric region 425 and the fifth dielectric region 426 extend to a location with a specific distance from two edges of the upper substrate.

Figure 5:
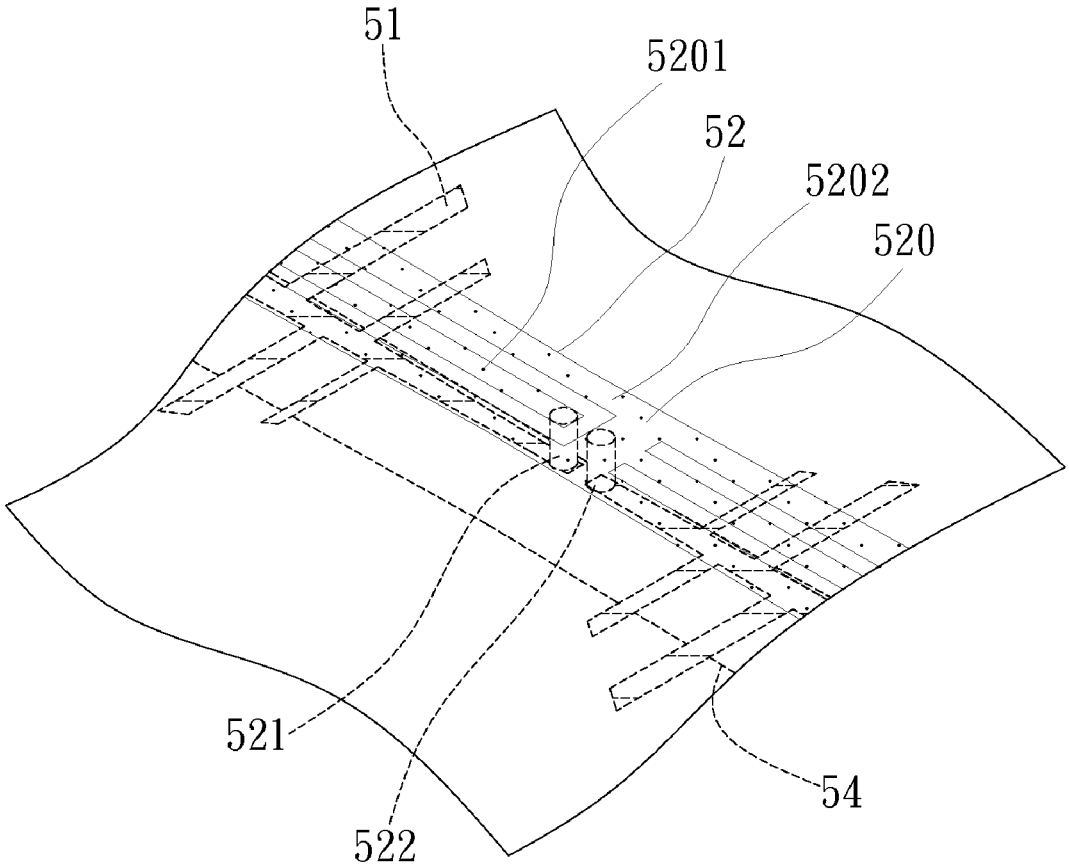
FIG. 5 is a perspective view of part of the structure of the CPW fed planar log-periodic antenna according to the present invention.

FIG. 5 is a perspective view of a part of the structure of the CPW fed coplanar log-periodic antenna. Therein, a planar log-periodic antenna structure 51, a CPW-fed structure 52 and a wire structure 54 are shown. The CPW-fed structure 52 comprises a microstrip 520, a first feed through hole 521 and a second feed through hole 522. The microstrip 520 further comprises a signal transmission region 5201 and a signal ground region 5202. The first feed through hole 521 is vertically formed in the upper substrate and connected to the signal transmission region 5201 and the planar log-periodic antenna structure 51. The second feed through hole 522 is vertically formed in the upper substrate and connected to the signal ground region 5202 and the planar log-periodic antenna structure 51.

In practice, signal current flows into the signal transmission region 421 at the left part of the microstrip, passes through the first feed through hole 521 and reaches the left part of the planar log-periodic antenna structure 51. Since the first feed through hole 521 is very close in location to the second feed through hole 522, when the current flows through the first feed through hole 521, an induced current is produced in the second feed through hole 522 and flows into the right part of the planar log-periodic antenna structure 51. The signal current causes the emission of radiation from the planar log-periodic antenna structure 51 for energy transmission. Since signal is encapsulated between the microstrip structures disposed on and beneath the substrate, cross polarized radiation in an orthogonal direction (X-axis and Y-axis) is decreased and radiation power in Z-axis is increased.

In a preferred embodiment, the first feed through hole 521 is formed at one side of the third dielectric region 424 and the second feed through hole 522 is formed at the other side of the third dielectric region 424.

Further referring to FIG. 3*b*, in a preferred embodiment, the planar log-periodic antenna structure 31 comprises a first segment 311 and a second segment 312. Therein, the first segment 311 comprises a plurality of first subsegments 3111 arranged along the first segment 311 and perpendicular to and connected to the first segment 311. Each first subsegment 3111 has an extending direction opposite to that of adjacent first subsegments 3111, and the width of each first subsegment 3111 is smaller than the distance between said first subsegment and adjacent first subsegments. The second segment 312 further comprises a plurality of second subsegments 3121, and the second subsegments 3121 are symmetrical to the first subsegments 3111 with respect to the center of the planar log-periodic antenna structure 31.

In another preferred embodiment, the length of the first segment 311 is equal to that of the second segment 312, and the width of the first segment 311 and the second segment 312 increases towards two edges of the upper substrate.

In another preferred embodiment, the width of the first subsegments 3111 sequentially increases towards two edges of the upper substrate, and the length of the first subsegments 3111 sequentially increases towards two edges of the upper substrate.

In another preferred embodiment, the impedance of the CPW-fed structure matches that of the planar log-periodic antenna structure.

Further referring to FIG. 5, in another preferred embodiment, the first feed through hole 521 is connected to the first segment and the second feed through hole 522 is connected to the second segment, and the first feed through hole 521 is symmetrical to the second feed through hole 522 with respect to the center of the planar log-periodic antenna structure.

Figure 6:
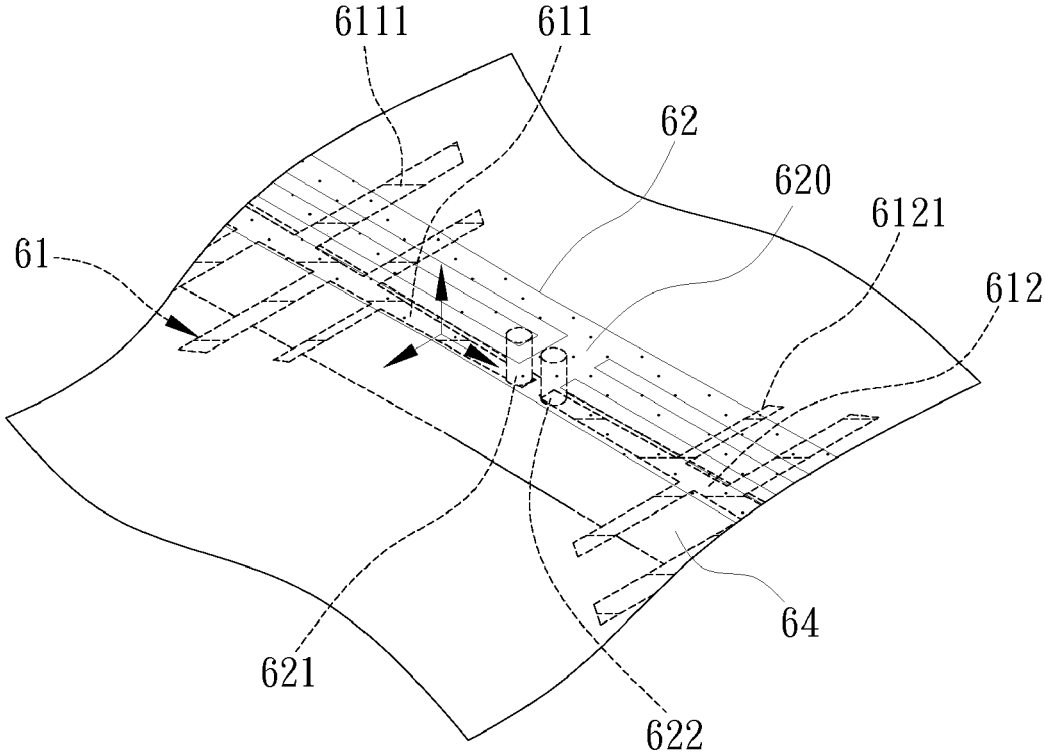
FIG. 6 is a perspective view of part of the structure of the CPW fed planar log-periodic antenna according to an embodiment of the present invention.

Referring to FIG. 6, in a preferred embodiment, a planar log-periodic antenna structure 61 comprises a third segment 611 and a fourth segment 612 formed on two sides thereof respectively. Similar to FIG. 3, the third segment 611 comprises a plurality of third subsegments 6111 arranged along the third segment 611 and perpendicular to and connected to the third segment 611. Each third subsegment 6111 has an extending direction opposite to that of adjacent third subsegments 6111, and the width of each third subsegment 6111 is smaller than the distance between said third subsegment and adjacent third subsegments. The fourth segment 612 further comprises a plurality of fourth subsegments 6121 arranged along the fourth segment 612 and perpendicular to and connected to the fourth segment 612. The number of the fourth subsegments 6121 is same as the number of the third subsegments 6111. Each fourth subsegment 6121 has an extending direction opposite to that of adjacent fourth subsegments, and the width of each fourth subsegment 6121 is smaller than the distance between said fourth subsegment and adjacent fourth subsegments. Compared with FIG. 5, the planar log-periodic antenna structure 61 and the CPW-fed structure 62 of FIG. 6 offset a specific distance along X-axis, thereby resulting in a location offset of the signal feed point, i.e., the first feed through hole 621.

During implementation of the planar log-periodic antenna of FIG. 5, the maximum value of the gain pattern deviates to side when frequency increases. The reason is that the CPW-fed structure cannot provide exactly same feed energy with a phase difference of 180 degree to the two sides of the antenna structure. Thus, when the radiation gain of the whole antenna cannot be as high as at the double feed points, the maximum value of the gain pattern deviates to side. Therefore, FIG. 6 adjusts the feed point for stabilizing the antenna gain at side.

In a preferred embodiment, the width of the third segment 611 and fourth segment 612 increase towards two edges of the upper substrate. The length of the third segment 611 is larger than that of the fourth segment 612. The width and length of the third subsegments 6111 sequentially increase towards two edges of the upper substrate, and the width and length of the fourth subsegments 6121 sequentially increase towards two edges of the upper substrate.

In another preferred embodiment, the first feed through hole 621 is connected to the third segment 611 and the second feed through hole 622 is connected to the fourth segment 612. The first feed through hole 621 is very close in location to the second feed through hole 621. As a result, when a current flows through the first feed through hole 621, an inducted current is produced in the second feed through hole 622 and further flows to the fourth segment 612.

Figure 7:
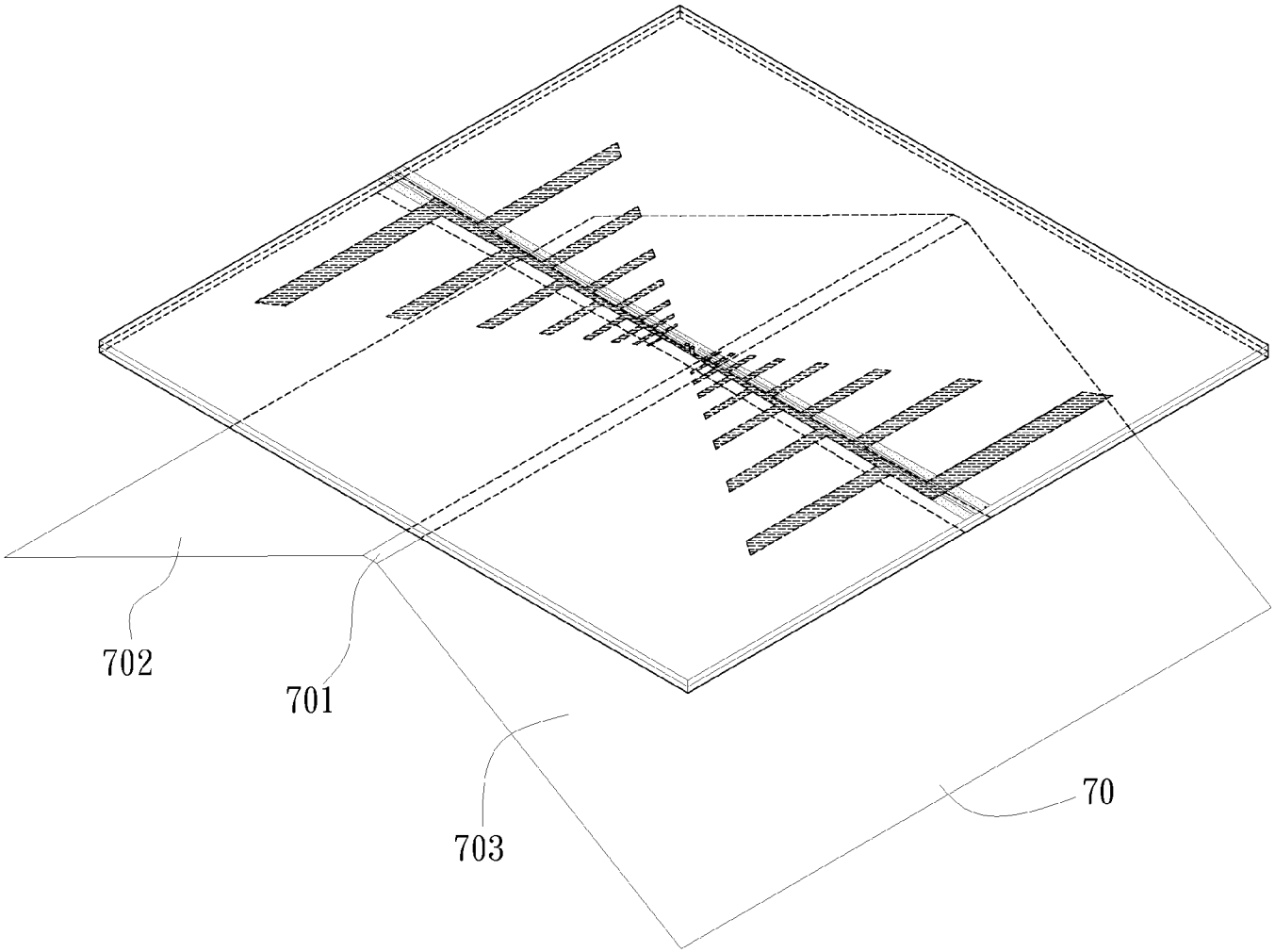
FIG. 7 is a perspective view of the CPW fed planar log-periodic antenna according to another embodiment of the present invention.

FIG. 7 is a perspective view of a CPW fed planar log-periodic antenna according to another embodiment of the present invention. In the present embodiment, the radiation direction of the antenna is designed so as to prevent the radiation from adversely affecting devices disposed below the antenna. The present invention also takes into account use efficiency and gain of the antenna radiation pattern.

In a preferred embodiment, the CPW fed planar log-periodic antenna further comprises a reflection plate 70 disposed a specific distance below the lower substrate for reflecting downward radiation produced by the antenna. The reflection plate 70 comprises a first plane 701 in parallel with the lower substrate, a second plane 702 forming a first angle with the lower substrate and connecting the first plane 701, and a third plane 703 forming a second angle with the lower substrate and connecting the first plane 701. By disposing the reflection plate below the antenna, circuit below the antenna is prevented from being adversely affected by the radiation and meanwhile the intensity of upward radiation is increased through reflection wave.

In another preferred embodiment, the first angle and the second angle are determined by the ratio of the wavelength to the distance between the planar log-periodic antenna and the reflection plate. If the reflection plate is not properly designed, the reflected radiation cannot overlap with the original upward radiation, thereby leading to loss of the antenna power. Therefore, the distance between the reflection plate and the planar log-periodic antenna is designed according to the wavelength of radiation of the planar log-periodic antenna such that the original radiation wave and the reflection wave can have a same direction, thereby increasing the antenna power in this direction.

In another preferred embodiment, the CPW fed planar log-periodic antenna further comprises an absorption device disposed below the lower substrate for absorbing downward radiation of the planar log-periodic antenna. An advantage of the absorption device is it does not need to be designed according to the antenna. In addition, the absorption device is easy to assemble and has low cost and is suitable to be applied to mobile communication devices.

Therefore, the CPW fed planar log-periodic antenna of the present invention not only has advantages of small volume, low cost and easy fabrication, but also encapsulates the planar log-periodic antenna through the wire structure and CPW-fed structure such that energy can only be transmitted in the encapsulated region without radiation, thereby decreasing cross polarized radiation of the antenna. The present invention also increases the antenna power at a specific direction through a reflection plate.

The above-described descriptions of the detailed embodiments are only to illustrate the preferred implementation according to the present invention, and it is not to limit the scope of the present invention, Accordingly, all modifications and variations completed by those with ordinary skill in the art should fall within the scope of present invention defined by the appended claims.

What is claimed is:

1. A coplanar waveguide (CPW) fed planar log-periodic antenna, comprising:

an upper substrate;

a planar log-periodic antenna structure formed beneath the upper substrate;

a CPW-fed structure formed on the upper substrate for feeding energy into the planar log-periodic antenna structure;

a lower substrate disposed beneath the upper substrate; and a wire structure formed beneath the lower substrate, wherein the CPW-fed structure comprises:

a microstrip formed on the upper substrate with a width increasing towards two edges of the upper substrate, wherein the microstrip comprises:

a signal transmission region with a width increasing towards two edges of the upper substrate, wherein a first dielectric region, a second dielectric region and a third dielectric region are formed around the signal transmission region, in which the first dielectric region and the second dielectric region extend towards two edges of the upper substrate and form an angle with the third dielectric region, and with a fourth dielectric region and a fifth dielectric region formed at locations spaced out a specific distance apart from the first dielectric region and the second dielectric region respectively, with the fourth and fifth dielectric regions extending towards two edges of the upper substrate; and a signal ground region formed outside the signal transmission region and the first to fifth dielectric regions; and through holes vertically formed in the upper substrate and connected to the microstrip and the planar log-periodic antenna structure, wherein the through holes comprise:

a first feed through hole vertically formed in the upper substrate and connected to the signal transmission region and the planar log-periodic antenna structure; and a second feed through hole vertically formed in the upper substrate and connected to the signal ground region and the planar log-periodic antenna structure.

2. The antenna of claim 1, wherein the first dielectric region and the second dielectric region extend towards two edges of the upper substrate.

3. The antenna of claim 1, wherein the first dielectric region and the second dielectric region have stripped shapes and equal widths.

4. The antenna of claim 1, wherein the third dielectric region has a stripped shape and specific width.

5. The antenna of claim 1, wherein the first feed through hole is formed at one side of the third dielectric region and the second feed through hole is formed at the other side of the third dielectric region.

6. The antenna of claim 1, wherein the fourth dielectric region and the fifth dielectric region extend towards a location at a specific distance from the edges of the upper substrate.

7. The antenna of claim 1, wherein the planar log-periodic antenna structure comprises:

a first segment formed at one side of the planar log-periodic antenna structure and having a plurality of first subsegments arranged along the first segment and perpendicular to the first segment, wherein the first subsegments are connected to the first segment, and any one of the first subsegments has an extending direction opposite to its two adjacent first subsegments, and a width of the first subsegment is smaller than a distance between the first subsegment and its adjacent first subsegments; and a second segment formed at the other side of the planar log-periodic antenna structure and comprising a plurality of second subsegments, wherein each of the second subsegments is symmetrical to each of the first subsegments with respect to a center of the planar log-periodic antenna structure.

8. The antenna of claim 7, wherein the length of the first segment is equal to that of the second segment.

9. The antenna of claim 7, wherein a width of the first segment increases towards two edges of the upper substrate.

10. The antenna of claim 7, wherein a width of the second segment increases towards two edges of the upper substrate.

11. The antenna of claim 7, wherein a width of each of the first subsegments sequentially increases towards two edges of the upper substrate.

12. The antenna of claim 7, wherein a length of each of the first subsegments sequentially increases towards two edges of the upper substrate.

13. The antenna of claim 7, wherein an impedance of the CPW-fed structure matches that of the planar log-periodic antenna structure.

14. The antenna of claim 7, wherein the first feed through hole is connected to the first segment and the second feed through hole is connected to the second segment.

15. The antenna of claim 7, wherein the first feed through hole is symmetrical to the second feed through hole with respect to the center of the planar log-periodic antenna structure.

16. The antenna of claim 1, wherein the planar log-periodic antenna structure further comprises:

a third segment formed at one side of the planar log-periodic antenna structure and having a plurality of third subsegments arranged along the third segment and perpendicular to the third segment, wherein the third subsegments are connected to the third segment, and any one of the third subsegment has an extending direction opposite to its adjacent third subsegments, and a width of the third subsegment is smaller than a distance between the third subsegment and its adjacent third subsegments; and a fourth segment formed at the other side of the planar log-periodic antenna structure opposite to the third segment and having a plurality of fourth subsegments arranged along the fourth segment and perpendicular to the fourth segment, wherein the number of the fourth subsegments is same as the number of the third subsegments, the fourth subsegments are connected to the fourth segment, and one of the fourth subsegment has an extending direction opposite to its adjacent fourth subsegments, and a width of each fourth subsegment is smaller than the distance between said fourth subsegment and adjacent fourth subsegments.

17. The antenna of claim 16, wherein a width of the third segment increases towards two edges of the upper substrate.

18. The antenna of claim 16, wherein a width of the fourth segment increases towards two edges of the upper substrate.

19. The antenna of claim 16, wherein both width and length of the third subsegments sequentially increase towards two edges of the upper substrate.

20. The antenna of claim 16, wherein both width and length of the fourth subsegments sequentially increase towards two edges of the upper substrate.

21. The antenna of claim 16, wherein the first feed through hole is connected to the third segment and the second feed through hole is connected to the fourth segment.

22. The antenna of claim 21, wherein a length of the third segment is larger than that of the fourth segment.

23. The antenna of claim 1, further comprising a reflection plate disposed a specific distance below the lower substrate so as to reflect a downward radiation produced by the planar log-periodic antenna.

24. The antenna of claim 23, wherein the reflection plate comprises:

a first plane in parallel with the lower substrate;

a second plane formed a first angle with the lower substrate and connected to the first plane; and a third plane formed a second angle with the lower substrate and connected the first plane.

25. The antenna of claim 24, wherein the first angle and the second angle are determined by a ratio of a wavelength and a distance of the planar log-periodic antenna to those of the reflection plate.

26. The antenna of claim 1, further comprising an absorption device disposed below the lower substrate for absorbing downward radiation produced by the planar log-periodic antenna.

* * * * *